US006902270B2

(12) United States Patent
Unosawa

(10) Patent No.: US 6,902,270 B2
(45) Date of Patent: Jun. 7, 2005

(54) PRINTER

(75) Inventor: Yasuhiro Unosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/251,839

(22) Filed: Sep. 23, 2002

(65) Prior Publication Data

US 2003/0058323 A1 Mar. 27, 2003

(30) Foreign Application Priority Data

Sep. 27, 2001 (JP) ..... 2001-295707

(51) Int. Cl.[7] ..... B41J 2/29; B41J 3/36; B41J 3/39

(52) U.S. Cl. ..... 347/108; 400/88

(58) Field of Search ..... 400/88; 361/679, 361/681, 682; 347/108, 109; 399/108

(56) References Cited

U.S. PATENT DOCUMENTS 4,789,876 A * 12/1988 Miyai et al. ..... 399/108
6,076,923 A 6/2000 Kashimura et al.
6,494,633 B1 * 12/2002 Crosby et al. ..... 400/668

* cited by examiner

*Primary Examiner*—Michael S. Brooke
(74) *Attorney, Agent, or Firm*—Fitzpatrick, Cella, Harper & Scinto

(57) ABSTRACT

There is provided a printer including a grip portion that becomes a handhold in moving the printer, and the grip portion is formed of a part of a jacket of the printer.

8 Claims, 10 Drawing Sheets

PRINTER

BACKGROUND OF THE INVENTION

1. Field of the Invention

The present invention relates to a printer and, in particular, to a printer that can be carried easily.

2. Related Background Art

In recent years, in accordance with the spread of personal computers, word processors, facsimile machines or the like in offices, various recording apparatuses have been developed as outputting machines for these appliances.

In particular, an ink jet recording apparatus for discharging ink to a material to be recorded to form an image is used as a recording apparatus in various fields because it is excellent in balance of image quality, printing speed, size, price or the like and can easily accommodate color recording. Therefore, various types of the apparatus are required. As one form of the apparatus, an ink jet recording apparatus of a so-called serial type is most generally used. The ink jet recording apparatus of the serial type has an ink jet recording head, which is formed integrally with an ink tank for supplying ink to the ink jet recording head, or an ink tank, which is detachably combined with an ink jet recording head, mounted on a carriage functioning as a head mounting unit and which reciprocatingly moves the head in a direction perpendicular to a conveying direction of a material to be recorded across a recording area to perform line recording for one or more lines.

One of the characteristics of the above-described form is that it is suitable for miniaturization of the apparatus. As a result, as apparatus that have been miniaturized, not only an ink jet printer of a stationary type, but also an ink jet printer of a type that a user can easily carry (a portable printer) has been realized. In addition, not only portable ink jet printers, but also portable printers according to other recording systems have been placed in the market.

However, there are problems as described below when a user tries to move a conventional printer.

FIG. 8 is a view of an appearance of a conventional printer viewed obliquely from its back. FIG. 9 is a horizontal sectional view of the conventional printer. In FIGS. 8 and 9, when a user tries to move the printer, since there is no grip or the like to be a handhold, the user must use his/her both hands to hold both right and left sides of the printer and move it. In this case, there is a problem in that the printer cannot be moved with one hand. In addition, there is a problem in that the printer may be dropped due to slipping out of the hands.

As a measure for coping with such a danger of dropping the printer, a printer has been devised which is provided with recessed portions 17 to be handholds in the lower parts on both the sides of the printer as shown in FIG. 10. However, in this case, there is also a problem in that the printer cannot be moved with one hand. In addition, a space occupied by components inside the printer may be compressed because the recessed portions 17 are provided. Therefore, there is a problem in that a change in design of the components inside the printer or enlargement of an outer jacket is required.

In addition, a form in which a grip dedicated for a handhold is formed of a separate member and attached to a printer is also devised. However, there is a problem in that it increases costs and spoils the aesthetic appearance of the printer.

SUMMARY OF THE INVENTION

The present invention has been achieved in view of the above and other drawbacks, and it is an object of the present invention to provide a printer whose main body can be moved easily and safely with one hand.

In addition, it is another object of the present invention to provide a printer in which, even if a function with which a user can move a printer main body easily and safely with one hand is added, the function does not affect other functions of the printer and an increase in size of the printer can be avoided.

In addition, it is another object of the present invention to provide a printer that, even if a function with which a user can move a printer main body easily and safely with one hand is added, does not increase costs and does not spoil its aesthetic appearance.

Further, it is yet another object of the present invention to provide a printer that is provided with a grip portion to be a handhold in moving the printer, which grip portion is formed of a part of a jacket of the printer.

DESCRIPTION OF THE PREFERRED EMBODIMENTS

Details of an embodiment in accordance with the present invention will be described with reference to the accompanying drawings.

First of all, a configuration of a printer of this embodiment will be described. This printer has a conveyance mechanism for conveying a material to be recorded (recording material) and a carriage functioning as a mounting member that is mounted with recording means for recording an image on the material to be recorded and which moves serially.

Figure 3:
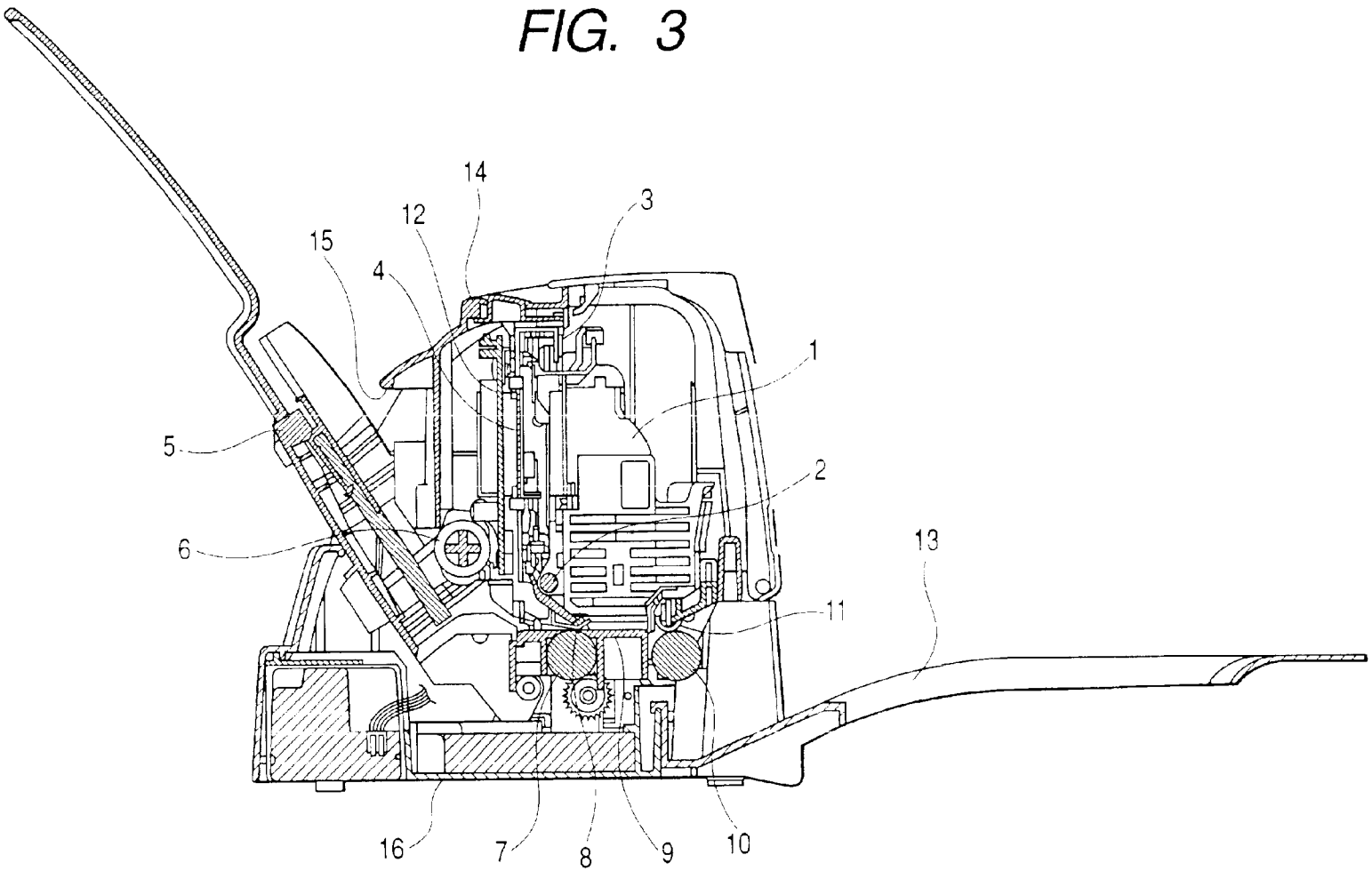
FIG. 3 is a horizontal sectional view of the printer in which the present invention is implemented.

A configuration of a recording device will be described. As shown in FIG. 3, a recording head (not shown) for discharging ink is mounted on a carriage 1. As the recording head (not shown), for example, an ink jet head is adopted which heats and foams ink in a flow path by a heating body to obtain discharge energy for discharging the ink. The carriage 1 is supported by a carriage shaft 2 and a guide rail 3 and is driven by a carriage driving motor (not shown) via a belt (timing belt) (not shown) to move reciprocatingly.

One side in a width direction of a recording material (direction perpendicular to a conveying direction of a material to be recorded) of a printer chassis 4 is assumed to be a reference side to be a reference for positioning of the carriage 1 or the like, and the other side is assumed to be a non-reference side. Then, a recovery unit (not shown), which has a suction and recovery function for function recovery and performance maintenance of the recording head (not shown) and a wiper function for wiping an ink discharge port installation surface of the recording head (not shown), is arranged in front of the reference side of the printer chassis 4.

Next, a configuration of a conveyance mechanism will be described. An auto sheet feeder 5 that is capable of stacking a large number of materials to be recorded is provided. As shown in FIG. 3, in a conveyance route of a material to be recorded from the auto sheet feeder 5, there are provided a sheet feed roller 6 for separating the materials to be recorded one by one, a conveyance roller 7 driven to rotate by a sheet feed driving motor (not shown) and a pinch roller 8 for bringing the material to be recorded into press contact with the conveyance roller 7 by a biasing spring (not shown). Moreover, downstream of a platen 9, there are provided a sheet discharge roller 10 driven to rotate and a spur 11 functioning as a sheet discharge driven rotating body for bringing the recorded recording material into press contact with the sheet discharge roller 10.

Further, the printer chassis 4 positions and holds the above-described carriage shaft 2, guide rail 3, auto sheet feeder 5, carriage driving motor (not shown), sheet feed driving motor (not shown), a recovery unit (not shown), a control substrate 12, or the like, and rotatably holds the conveyance roller 7 and the sheet discharge roller 10. Moreover, the printer chassis 4 is fixed to a bottom case 16 by screws.

Next, operations of this ink jet printer will be described in accordance with a flow of a material to be recorded (recording sheet). When sheet feeding from the auto sheet feeder 5, the material to be recorded is conveyed to a contact point of the conveyance roller 7 and the pinch roller 8 by the sheet feed roller 6. Then, the conveyance roller 7 is driven by the sheet feed driving motor (not shown) and is rotated in a state in which the material to be recorded is in press contact with it by the biasing spring (not shown) and the pinch roller 8, and the material to be recorded is conveyed to the platen 9.

While the recording material is positioned at the platen 9, a heat generating body (not shown) arranged in the recording head is driven synchronously with the carriage 1 scanning in the width direction of the material to be recorded, and ink is appropriately discharged onto the material to be recorded from the recording head (not shown). When one scanning of the carriage 1 is completed, the material to be recorded is conveyed by a predetermined pitch (until an unrecorded part of the material to be recorded comes to be opposed to the recording head). Thereafter, the carriage 1 scans again and ink for the next row is discharged from the recording head (not shown). In this way, the conveyance of the material to be recorded by the predetermined pitch, the movement of the carriage 1 and the discharge of ink from the recording head (not shown) are alternately performed, whereby it becomes possible to record an image on the entire surface of one sheet of recording material.

The recording material on which an image has been recorded by the recording head (not shown) in the platen 9 is discharged to the outside by the sheet discharge roller 10 and the spur 11 and, then, discharged to a discharged sheet tray 13 and held therein.

Next, an embodiment of the present invention will be described in detail with reference FIGS. 1 to 7.

Figure 1:
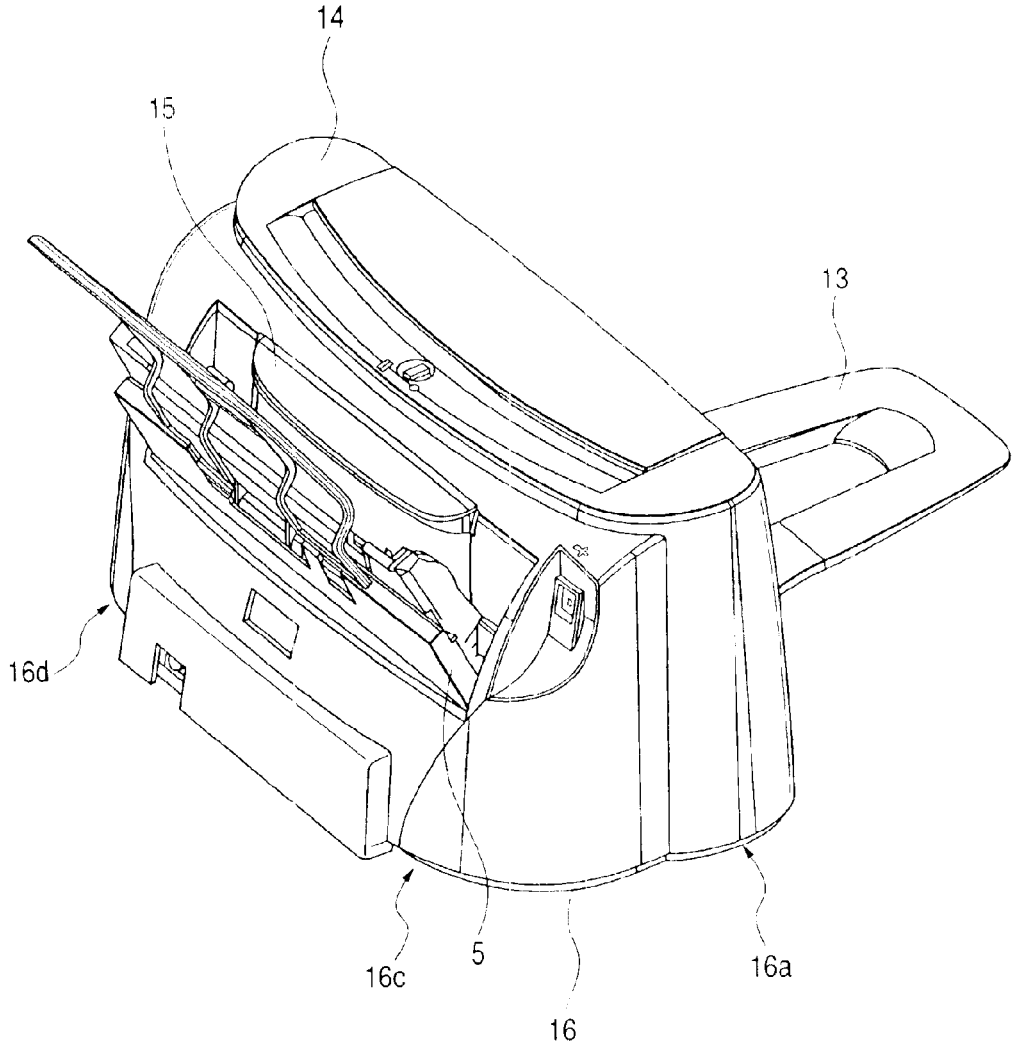
FIG. 1 is a view of an appearance of a printer in which the present invention is implemented viewed obliquely from its back.
Figure 2:
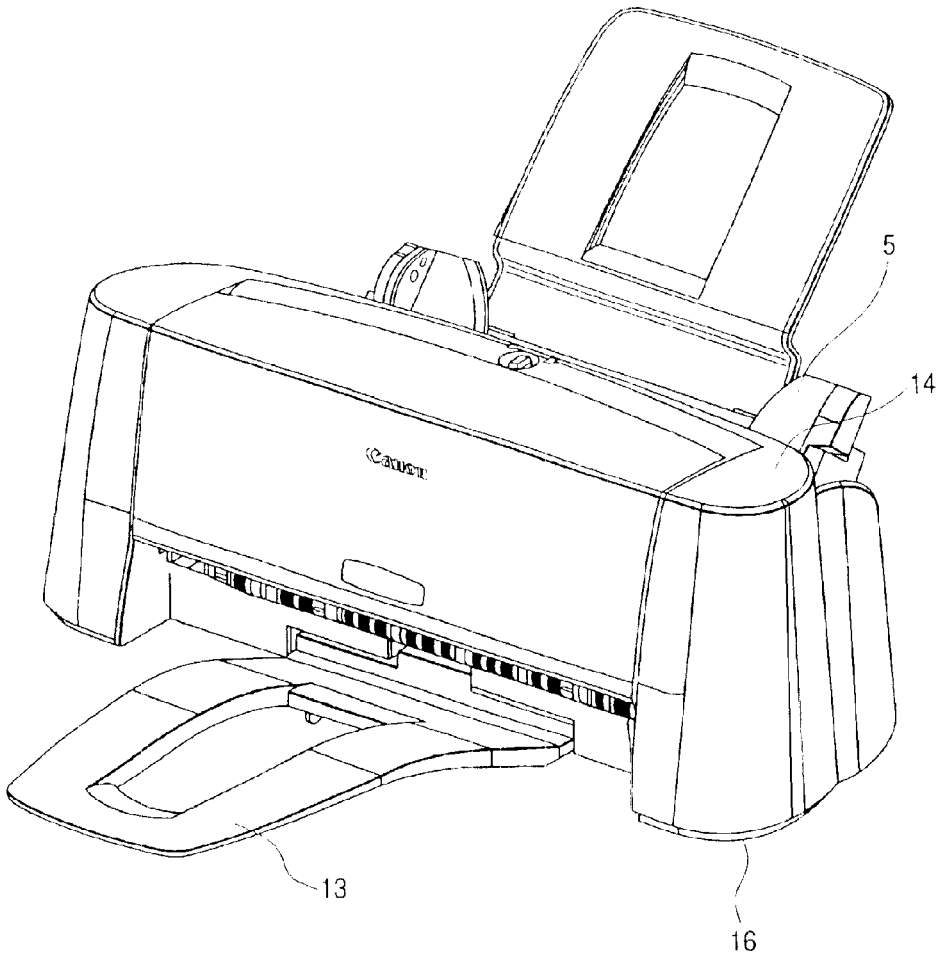
FIG. 2 is a view of the appearance of the printer in which the present invention is implemented viewed obliquely from its front.
Figure 6:
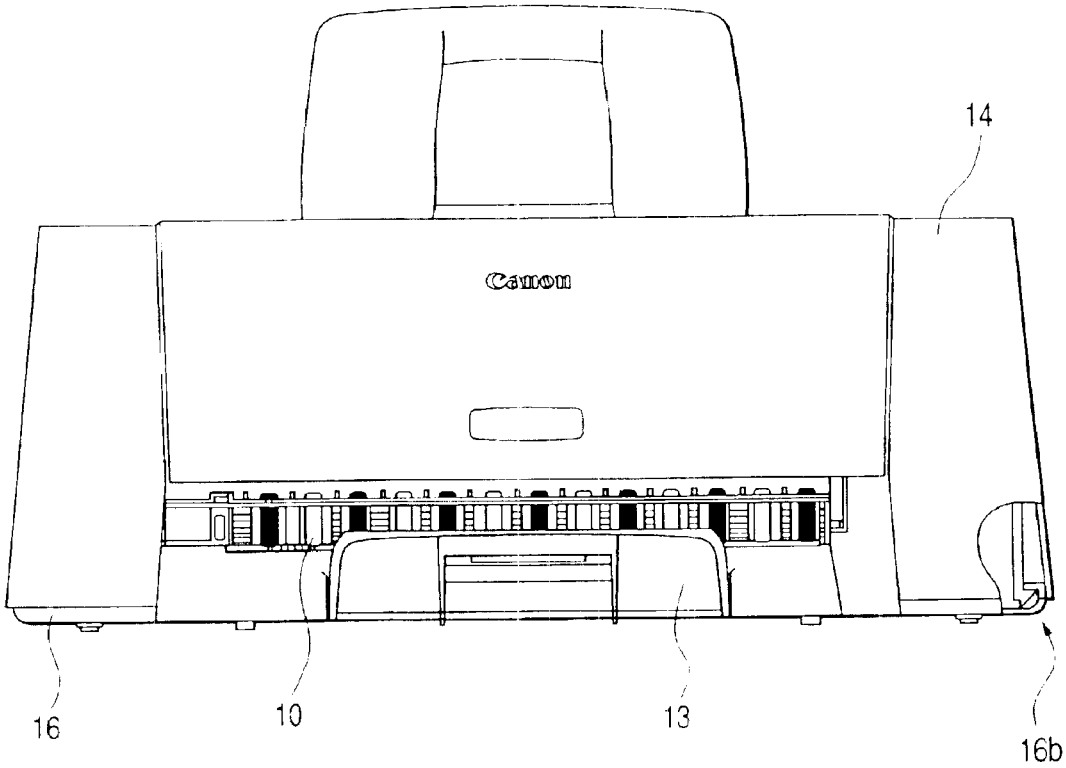
FIG. 6 is a view of the appearance of the printer in which the present invention is implemented viewed from its front.
Figure 7:
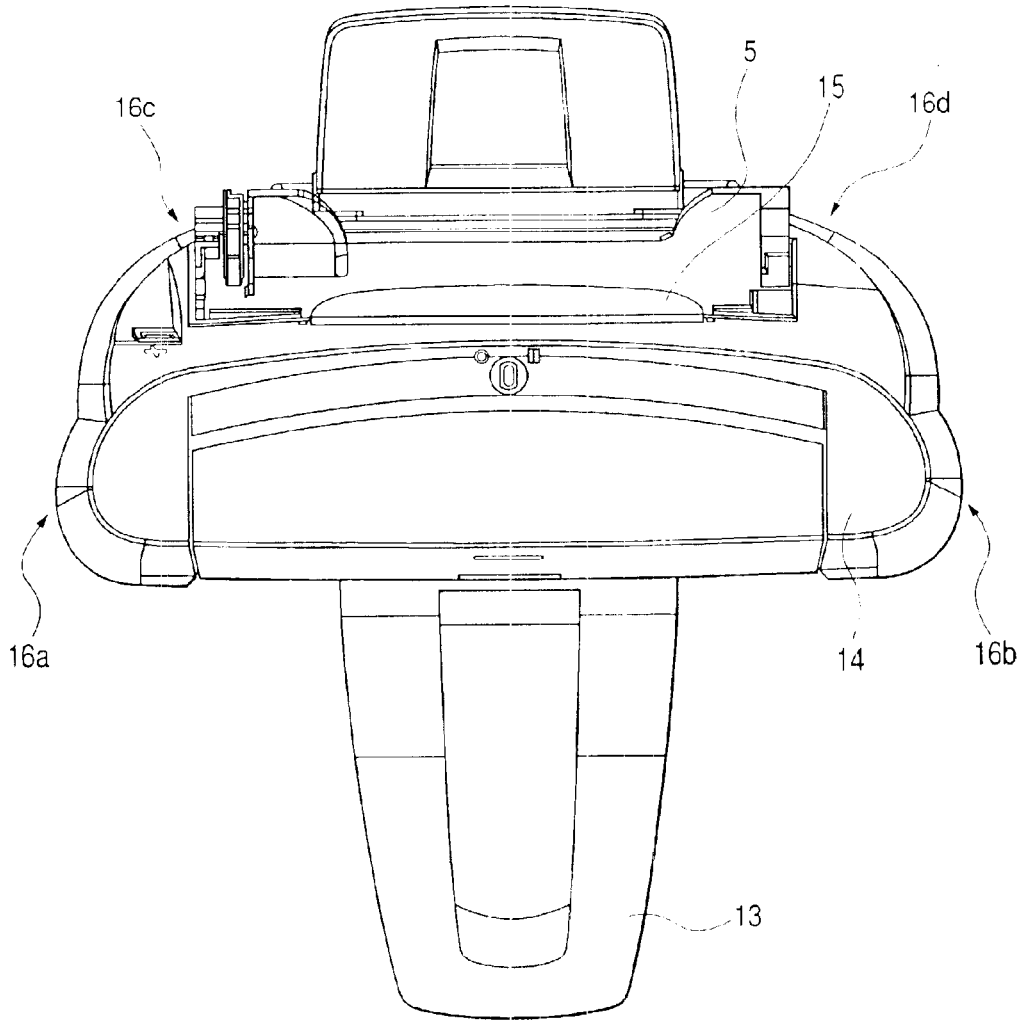
FIG. 7 is a view of the appearance of the printer in which the present invention is implemented viewed from above.
Figure 8:
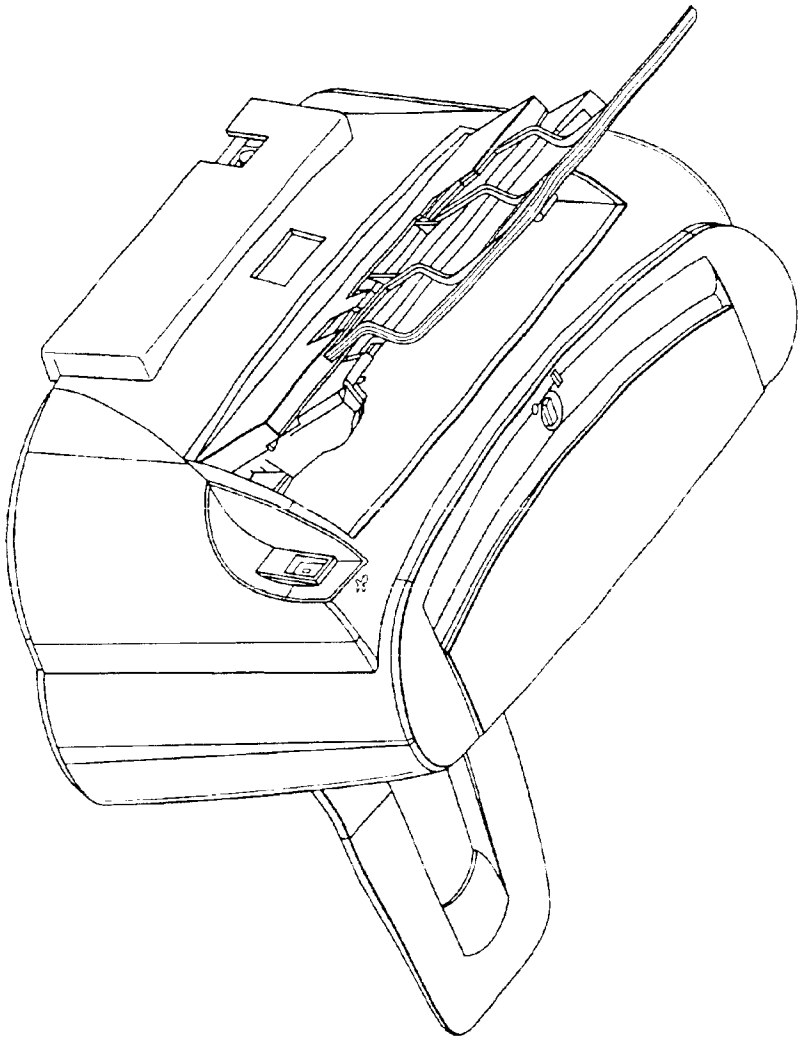
FIG. 8 is a view of an appearance of a conventional printer viewed obliquely from its back.
Figure 9:
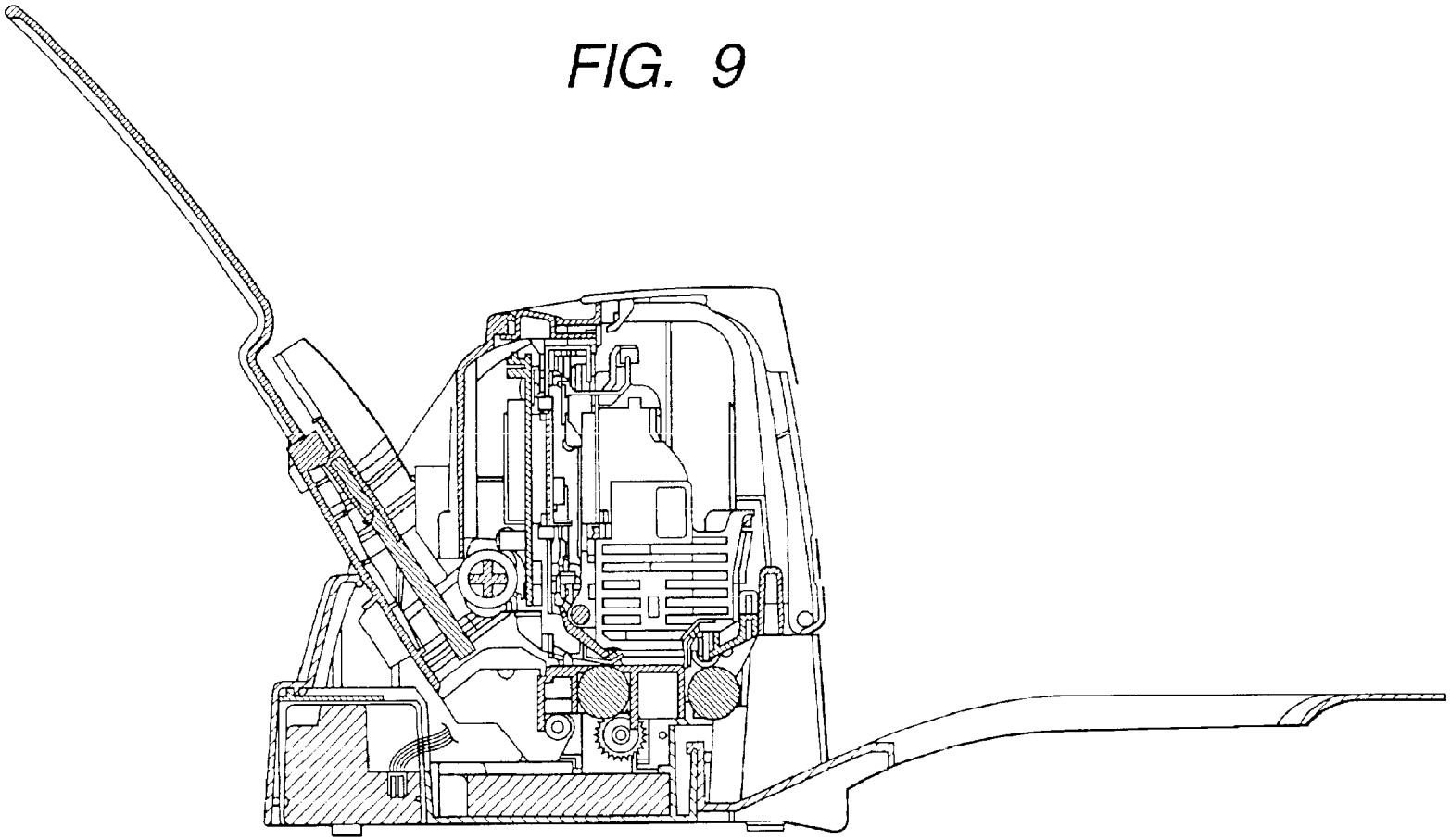
FIG. 9 is a horizontal sectional view of the conventional printer.
Figure 10:
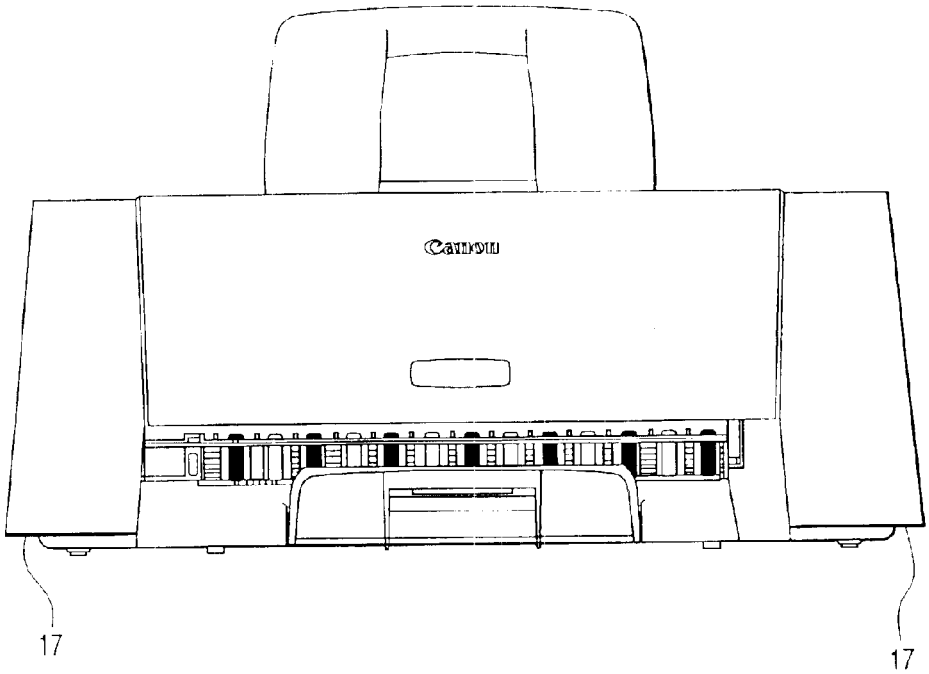
FIG. 10 is a view showing a printer provided with recessed portions for handholds among conventional printers.

FIG. 1 is a view of an appearance of a printer as an embodiment of the present invention viewed obliquely from its back. FIG. 2 is a view of the appearance of the printer of the embodiment viewed obliquely from its front. FIG. 6 is a view of the appearance of printer of this embodiment viewed from its front. FIG. 7 is a view of the appearance of the printer of this embodiment viewed from above.

In FIGS. 1, 2, 6 and 7, reference numeral 5 denotes an auto sheet feeder; 13, a discharged sheet tray; and 14, an upper cover as an outer jacket of the printer. The upper cover 14 is engaged with the bottom case 16, to which the printer chassis 4 is secured, at both right and left side portions (16*a* and 16*b* of FIGS. 1 and 7) and at two rear parts (16*c* and 16*d* of FIGS. 1 and 7) by so-called snap engagement, that is, elastically deforming an engagement member to engage with two members (see FIG. 6).

In addition, reference numeral 15 denotes a grip, which is formed in a part of the upper cover 14 and which becomes a handhold in moving a printer main body. The grip 15 is provided at only one location substantially in the central section of the printer. As seen from these drawings, the grip 15 is formed without spoiling the aesthetic appearance of the printer.

Moreover, an actual state of using the grip 15 will be described with reference to FIGS. 4 and 5.

Figure 4:
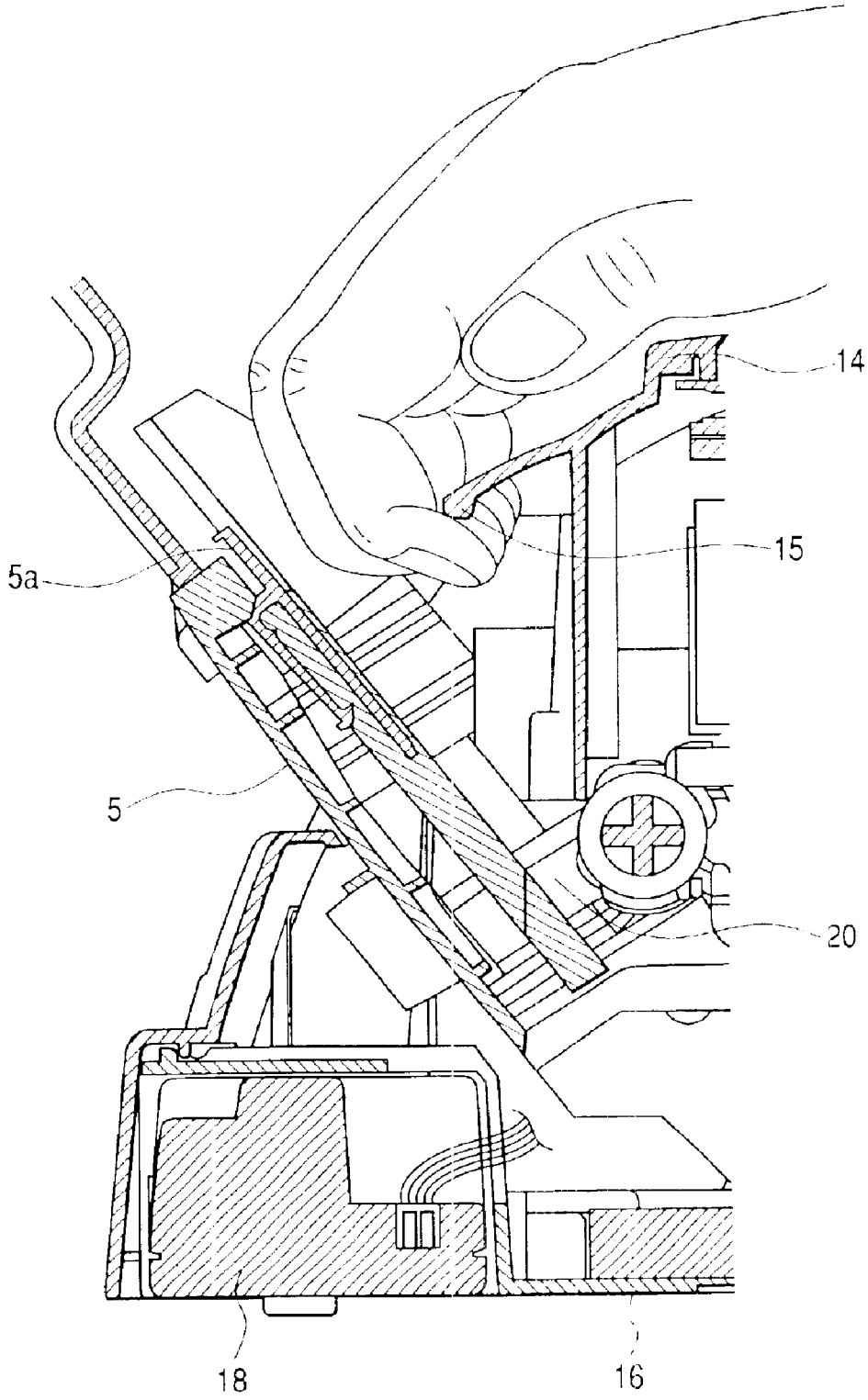
FIG. 4 is a view for illustrating details of a grip portion of FIG. 3.

FIG. 4 is a view illustrating details of the grip in FIG. 3. As shown in FIG. 3, the grip 15 is provided above the auto sheet feeder 5 and a feed opening 20 for feeding a material to be recorded to the printer main body and extends from the upper cover 14 toward the rear of a back surface 19 of the printer. Further, this grip 15 is formed such that its installation does not affect the function of supplying a material to be recorded.

In addition, as shown in FIG. 4, a user or the like can move the printer main body easily and safely with one hand by holding the grip 15.

Figure 5:
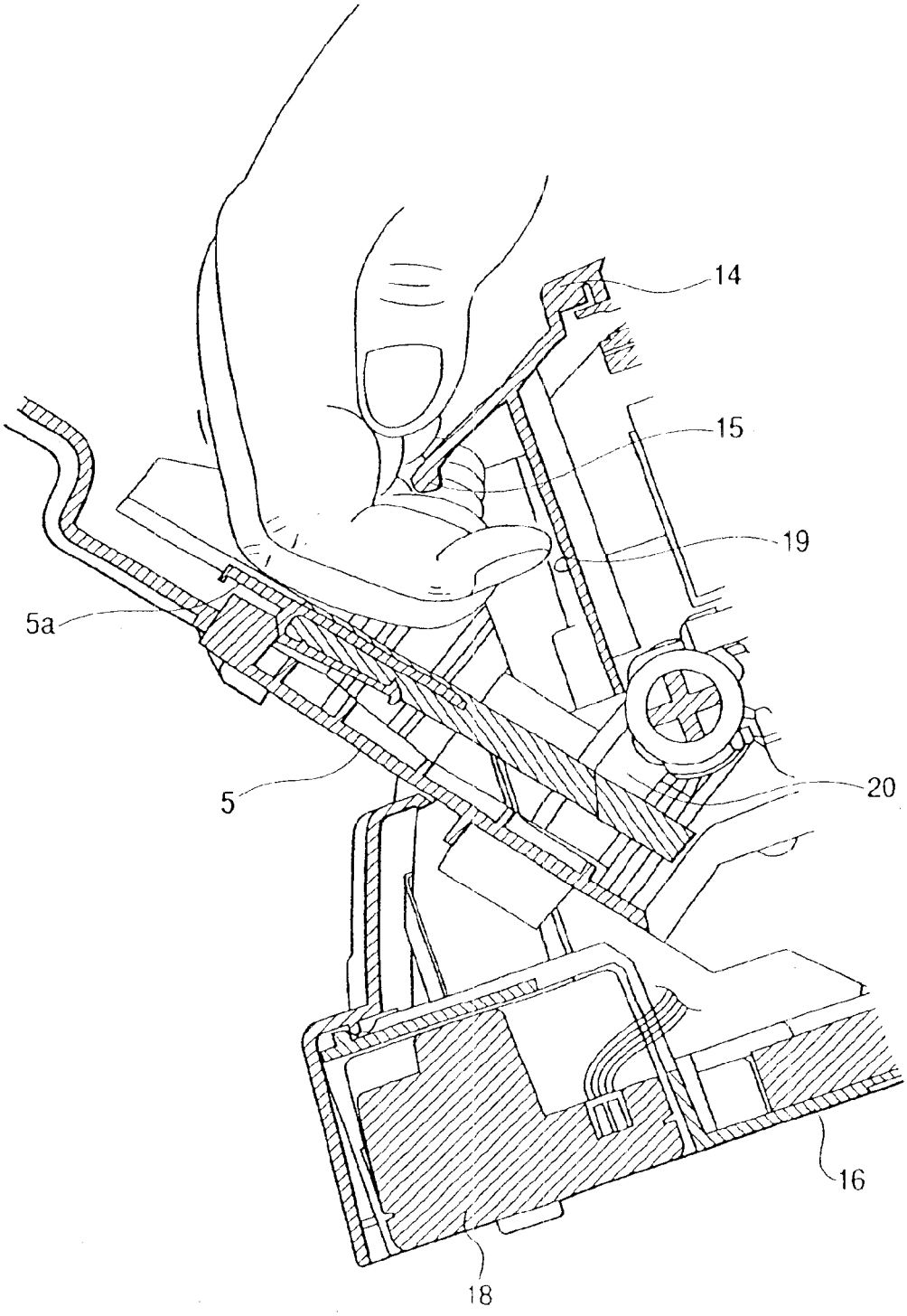
FIG. 5 is a view for illustrating details of the grip portion of FIG. 3.

Moreover, FIG. 5 shows a state in which a user or the like actually holds the grip 15 to lift the printer.

At this point, the outer side of the fingers of the user abuts a part of the auto sheet feeder 5 (a pressure plate 5*a* in the case of this embodiment) and the tip portion of the fingers or the outer side of the fingers abuts the backside of the grip 15 or the back surface 19. Further, in a state in which the printer is lifted, the center of gravity of the printer or a power supply. 18 that is a heavy component is positioned below the grip 15.

That is, one corner of a space of a substantially triangular shape in its cross section (see FIG. 5) along the conveying direction of a material to be recorded constituted by the grip 15, the back surface 19, which is a part of the jacket of the printer, and the pressure plate 5*a*, which is a member forming a part of the conveyance route, is the feed opening 20, and another corner is an opening for inserting fingers. Moreover, the center of gravity of the printer or a heavy component is arranged to be positioned below the substantially triangular-shaped space.

Consequently, a stable state in which the hand holding the grip 15 is prevented from slipping off can be generated and the user or the like can carry the printer more safely and stably with one hand. Moreover, since the grip 15 is positioned above an area where the center of gravity of the printer main body (the position of the power supply or its vicinity), the posture of the printer main body can be stabilized even when the printer main body is lifted and carried.

Further, in this embodiment, the present invention can be preferably used in any of printers of a so-called serial type and full line type. In addition, the present invention can be preferably used in a printer regardless of its recording system, including those systems that use an ink jet recording head based on various ink discharge principles, a heat transfer recording head, a sublimation recording head and a wire dot recording head as recording means, and a system for forming a latent image using light from a light source such as a laser beam. Moreover, in the case of the ink jet recording system, the present invention can be preferably used in a printer of any form such as a form in which an ink tank is constituted integrally with a recording head on a carriage, a form in which an ink tank is installed on a main body side rather than on a carriage and a form in which a necessary minimum number of sub ink tanks are mounted on a carriage and ink is supplied to the sub ink tanks from a main ink tank installed on a main body side.

As described above, according to this embodiment, a printer is provided whose main body can be moved easily and safely with one hand.

In addition, a printer can be realized in which, even if a function with which a user can move a printer main body easily and safely with one hand is added, the function does not affect other functions of the printer and an increase in size of the printer can be avoided.

Further, a printer is provided which, even if a function with which a user can move a printer main body easily and safely with one hand is added, does not increase costs and does not spoil its aesthetic appearance.

What is claimed is:

1. A printer for recording an image on a recording material which is conveyed by a conveyance mechanism, comprising:

a grip portion that becomes a handhold in lifting or moving said printer;

an outer jacket having said grip portion formed as a part thereof; and an automatic sheet feeder for feeding the recording material, wherein said automatic sheet feeder is located at a position where an outer side of a hand contacts therewith when the hand contacts said grip portion and said printer is lifted and suspended from the hand, and when said printer is supported only by the hand, an upper surface of said outer jacket is balanced at a position higher than said grip portion, and wherein said grip portion is provided above an area where a center of gravity of a printer main body exists.

2. The printer according to claim 1, wherein said grip portion is provided above a feed opening for feeding the recording material into said printer.

3. The printer according to claim 1, wherein said printer records the image on the recording material using an ink jet recording head for discharging ink.

4. The printer according to claim 1, wherein outer sides of fingers of the hand contact with said automatic sheet feeder when the hand contacts said grip portion and said printer is lifted and suspended from the hand.

5. A printer for recording an image on a recording material that is conveyed by a conveyance mechanism, comprising:

a grip portion that is a part of a jacket of said printer and becomes a handhold in lifting or moving said printer, wherein a space of a substantially triangular shape in cross-section along a conveying direction of the recording material is defined by a back surface of said jacket and a member forming a part of a conveyance route of the recording material, one corner of said space being a feed opening, another corner of said space being an opening for inserting a hand, and a center of gravity of said printer or a heavy component being positioned below said space, said member is located at a position where an outer side of the hand contacts therewith when the hand contacts said grip portion by inserting into the opening and said printer is lifted and suspended from the hand, and when said printer is supported only by the hand, an upper surface of said jacket is balanced at a position higher than said grip portion.

6. The printer according to claim 5, wherein said printer records the image on the recording material by using an ink jet recording head for discharging ink.

7. The printer according to claim 5, wherein outer sides of fingers of the hand contact with said member when the hand contacts said grip portion and said printer is lifted and suspended from the hand.

8. A printer for recording on a recording material, said printer comprising:

a printer jacket having a rear surface;

a supply port for the recording material provided at the rear surface of said printer jacket;

an automatic sheet feeder for feeding the recording material through said supply port, said automatic sheet feeder having a stacking portion, projecting rearwardly from the rear surface of said printer jacket, for the recording material; and a grip portion provided above said supply port and projecting rearwardly from the rear surface of said printer jacket, said grip portion being formed by a part of said printer jacket and serving as a grip when the printer is lifted or moved, wherein said grip portion is stationary with respect to the printer and said supply port is located below said grip portion and an upper surface of said printer jacket is balanced at a position higher than said grip portion when the printer is supported only by a hand that contacts said grip portion.

* * * * *